US006193231B1

(12) United States Patent
Hannon

(10) Patent No.: US 6,193,231 B1
(45) Date of Patent: Feb. 27, 2001

(54) UNIVERSAL METERING HOPPER AND METHOD FOR HANDLING THICK OR THIN NEWSPAPER PRODUCTS

(75) Inventor: Charles N. Hannon, Olathe, KS (US)

(73) Assignee: Stepper, Inc., Olathe, KS (US)

( * ) Notice: Subject to any disclaimer, the term of this patent is extended or adjusted under 35 U.S.C. 154(b) by 0 days.

(21) Appl. No.: 09/245,522

(22) Filed: Feb. 5, 1999

(51) Int. Cl.[7] ..... B65H 3/52; B65H 3/60; B65H 3/24; B65H 1/00

(52) U.S. Cl. ..... 271/138; 271/133; 271/137; 271/161; 271/167; 271/131

(58) Field of Search ..... 271/133, 137, 271/161, 167, 138, 165, 131, 10.16

(56) References Cited

U.S. PATENT DOCUMENTS

| | | | | |
|---|---|---|---|---|
| 4,557,472 | | 12/1985 | Hannon . | |
| 4,771,896 | * | 9/1988 | Newsome | 271/3.1 |
| 4,911,421 | | 3/1990 | Hannon . | |
| 4,919,413 | | 4/1990 | Hannon . | |
| 5,042,792 | * | 8/1991 | Honegger | 271/188 |

FOREIGN PATENT DOCUMENTS

| | | | | |
|---|---|---|---|---|
| 406191658 | * | 7/1994 | (JP) | 271/167 |
| 0682435 | * | 8/1979 | (SU) | 271/165 |

* cited by examiner

*Primary Examiner*—Donald P. Walsh
*Assistant Examiner*—Daniel K Schlak
(74) *Attorney, Agent, or Firm*—Hovey Williams Timmons & Collins

(57) ABSTRACT

A bottom feed newspaper hopper utilizes a shuttle plate that reciprocates across the bottom of a stack of the papers to partially eject each successive lowermost newspaper from the stack during each feed stroke and present it to high speed nip rollers. The rollers grasp the leading edge of the partially ejected newspaper and quickly withdraw it the rest of the way from the stack. The stack of newspapers rests upon a fore-and-aft narrow rail on the shuttle plate so that a stiffening ridge is created in the body of the lowermost paper and at least several papers thereabove. During each feed stroke, a stop at the front of the hopper permits the lowermost paper to exit from the hopper but blocks similar movement of the second paper and all those above it. The stop is offset laterally from the path of travel of the rail so that the area immediately above the rail is open and unrestricted, allowing the peak of the ridge to pass out of the hopper even if the paper has an accidentally rolled up, fat leading edge. A downwardly and laterally outwardly flaring deflecting leg at the lower end of the stop pushes down on the side slope of the ridge as the paper moves forwardly toward the nip rollers so as to bend the side slope downwardly away from the surface of the next paper, thus encouraging separation of the lower paper from those above it in the stack. Several embodiments of separator stops are disclosed, including a dual stop version for thick newspaper products and a single stop version for relatively thin, flimsy newspaper products.

37 Claims, 7 Drawing Sheets

UNIVERSAL METERING HOPPER AND METHOD FOR HANDLING THICK OR THIN NEWSPAPER PRODUCTS

TECHNICAL FIELD

The present invention relates to newspaper handling equipment and, more particularly, to metering hoppers which are used to feed newspapers one at a time from a stack to other collating and handling equipment of the system at a high-speed, metered rate of delivery.

BACKGROUND

Newspapers and similar articles present unique and challenging problems insofar as feeding them at regular rates of delivery is concerned. At one extreme are large, bulky big city newspapers containing many sections as well as large quantities of loose, advertising inserts. At the other extreme are thin, 6 to 12 page tabloids and similar documents. Yet, a commercially successful metering hopper needs to be capable of handling both types of newspaper products at high speeds, and without jams or misfeeds. Time is always of the essence in the assembly and production of newspaper products; therefore, stoppage of the production line to clear a jammed hopper or address another feeding problem is particularly aggravating and inefficient, all of which contributes to the challenge of providing a metering hopper that can handle a wide range of thicknesses and sizes of newspaper products reliably and at high speeds.

My prior metering hoppers have operated on a bottom feed principle by which stacks of newspapers are loaded into the top of the hopper and fed one at a time out of the bottom of the hopper in a transverse direction. In certain of my prior metering hoppers, such as disclosed in U.S. Pat. Nos. 4,557,472 and 4,911,421, I used a reciprocating shuttle across the bottom of the stack to engage the lowermost newspaper and drive it a short distance forwardly into a pair of powered nip rollers which then gripped the newspaper and pulled it the rest of the way from the stack. A barrier or stop at the front of the hopper kept newspapers above the lowermost newspaper in the stack from feeding simultaneously with the lowermost paper, but without blocking or interfering with movement of the lowermost paper.

Broadly speaking, the separating stop in some of my prior hoppers operated on the principle of cooperating with the underlying feed shuttle to define a relatively narrow outlet slot through which each successive, lowermost newspaper could be ejected from the hopper. The slot was thick enough to allow passage therethrough of the lowermost newspaper, but was thin enough to prevent any additional newspapers from exiting with the lowermost paper. The thickness of the slot could be adjusted by adjusting the vertical position of the stop, thus making the hopper adaptable for newspapers of different thicknesses.

One problem with the ejecting slot concept is that newspapers have a tendency to vary in thickness throughout a production run, even though they theoretically all contain the same number of pages and inserts. Thus, it is difficult to find a perfect thickness for the slot that will permit it to accommodate the random occurrence of overly thick newspapers without having a slot that is simply too thick to prevent the second and third newspapers from also being fed along with the lowermost paper. Such variations in the thickness profile along the leading edge of the newspaper can occur for many reasons such as, for example, when the relatively slick advertising inserts and other loose materials within the inside of the newspaper become shifted around in the paper to a point where, in one paper they may be in line with the separating stop while in another paper they may be offset to one side of the stop and thus present a thinner profile at the exact point of separation by the stop. Furthermore, the hard fold line that presents the leading edge of each newspaper in the stack can sometimes roll up or "balloon" so that, instead of the desired regular profile at the front of the newspaper, the newspaper presents a thick, loose front profile that is considerably wider than the ejecting slot. When such a malformed paper cannot pass through the slot, the machine jams and the line shuts down until the jam can be cleared.

Sometimes the rolled front edge of the newspaper is created before the stack is ever placed in the hopper, and at other times it is created during the ejection stroke itself. Due to the slickness of the advertising inserts, there is a natural tendency for the loose newspapers to become disheveled during the considerable handling that occurs both before and during placement in the hopper. This can produce the rolled front edge. Even if the front edge is not in a rolled up condition at first, the inserts may be in such a location that when the feed stroke of the shuttle takes place, the outer section of the paper tends to slide forwardly instead of staying locked together with the inserts and the other sections. This causes the front edge to loosen and roll up, preventing passage of the paper through the metering slot.

In order to accommodate the sometimes rolled-up front edge of the newspapers, I have provided previous designs in which the separating stop at the front of the hopper is flexible rather than rigid. While the rigid stop blocks the enlarged newspaper from passing through the slot, a resilient stop is more forgiving and will allow problem papers to pass.

However, the accommodating nature of a resilient stop sometimes limits its effectiveness as a separator. There is a tendency for the stop to flex forwardly all the time and permit the front edges of the newspapers to become progressively stairstepped under the stop. This causes increased down pressure from the stop on the second and third newspapers such that the bottom newspaper has difficulty breaking free from the stack during the feed stroke. Consequently, it may encourage the feeding of doubles and triples, which is undesirable.

At the other extreme are very thin newspapers, such as tabloids and advertising pieces on the order of from 5 to 10 pages. The small number of pages in this type of product makes the products so thin that it is difficult to place the separating stop at exactly the right height to yield a perfectly dimensioned, thin slot. Although there is less tendency for these particular products to produce a rolled up front edge, the risk of feeding doubles and triples is much greater.

My prior U.S. Pat. No. 4,911,421 explains the discovery that forming a longitudinal ridge in the newspaper product as it is being separated from the bottom of the stack is very helpful. The ridge tends to lock in place loose advertising inserts and the like within the inside of the newspaper and provide a stiffening column within the body of the newspaper that can be pushed against by the feed shuttle as it ejects the paper. It also has the effect of creating side slopes in the ridge that angle down away from the next overhead paper so that friction between the two papers is reduced. Generally speaking, I have found that the narrower the ridge the better; however, having a narrow support rail under the bottom newspaper to create the ridge also reduces the degree of surface contact between the rail and the newspaper, thus decreasing the ability of the rail to grip the newspaper and feed it forwardly. When using a support rail, the metering or separating slot at the front of the hopper is defined between the separating stop and the stop edge of the rail so that the peak of the ridge passes through the slot during each feed stroke.

However, I have found that having the separating stop located directly above the narrow support rail in this manner tends to aggravate the problem of feeding doubles and triples in relatively thin products. Moreover, it does nothing to relieve the jamming problem that occurs when the leading edge rolls up on larger size newspapers.

SUMMARY OF THE DISCLOSURE

Accordingly, a primary object of the present invention is to provide a more universal high speed metering hopper for newspaper products that can more reliably handle products at both extremes of thickness and thinness while reducing the frequency of jams and the misfeeding of multiples.

Pursuant to the foregoing, I have now discovered that significantly better performance can be obtained in a metering hopper by not placing the separating stop directly above and in line with the ridge-forming support rail of the feed shuttle. Instead, I have found that by placing the stop in a laterally offset position relative to the support rail so that the area immediately above the rail is opened and relieved, very good results can be obtained over a wider range of newspaper thicknesses. With thick newspapers, having an occasional rolled-up front edge is no longer a problem. Although the bottom edge of the stop and the top edge of the support rail may still be a smaller distance apart than the thickness of the rolled-up front edge, by having the stop offset to the side of the rail rather than directly in line with it, the enlarged front edge of the peak of the ridge passes smoothly through the unrestricted open space above the rail. Furthermore, the drooping side slopes in the ridge of the newspaper deflect down and under the side of the stop as the rail pushes the paper forwardly. Consequently, jams are reduced.

With respect to thin newspaper products, having the stop off to the side of the support rail seems to make the height of the stop less critical. That is, there is less of a need to place the bottom edge of the stop at exactly the right place in order to avoid the feeding of doubles and triples.

In implementing this discovery, I have found that a number of different designs for the separating stop can be utilized, so long as the area immediately above the support rail is left open and relieved. For example, a preferred form of stop that is suitable for most big city newspapers is shaped somewhat like a two-pronged fork which straddles the support rail at its front end with the two stop prongs disposed on opposite sides of the rail. Although the stops are integrally joined to one another at their upper ends, such interconnection occurs at a significant distance above the top edge of the rail so that a sizable open space is presented immediately above the rail. The stops are vertically adjustable as a unit in accordance with the flexibility and thickness of the newspapers to be metered so that the open space above the rail is significantly taller than the thickness of the newspaper and the lower terminations of the two stops are generally in line with the side slopes of the ridge in the next newspaper in the stack.

Preferably, each of the stops is generally L-shaped as viewed in side elevation, with a generally upright blocking leg and a generally fore-and-aft deflecting leg. The deflecting leg projects downwardly at an incline from the blocking leg and flairs out at an angle so that, as the ridge of the lowermost newspaper passes between the stops, the deflecting legs cause the side slopes of the ridge to deform downwardly and inwardly toward one another, thus intensifying the ridging configuration and forcing the side slopes to separate more completely in a downward direction from the overhead surfaces of the next newspaper. Once the lowermost newspaper has thus been partially ejected from the stack, high speed nip rollers grab the leading edge and jerk the paper the rest of the way out of the stack.

In the case of very thin newspaper products, such as on the order of 6–12 pages, I have found that improved results can be obtained by using only a single stop rather than dual stops. The single stop remains offset laterally from the path of travel of the support rail so that the stop does not present a restriction directly above the rail. Best results have been obtained when an auxiliary support member is utilized beneath the front edge of the stack on the same side of the rail as the separating stop so that the slope of the ridge on that side of the rail is not as extreme as on the opposite side. Thus, the extremely flimsy, thin newspapers are not permitted to droop so far out of a horizontal plane that two or more of them can accidentally slip between the side of the stop and the rail.

DETAILED DESCRIPTION

Figure 1:
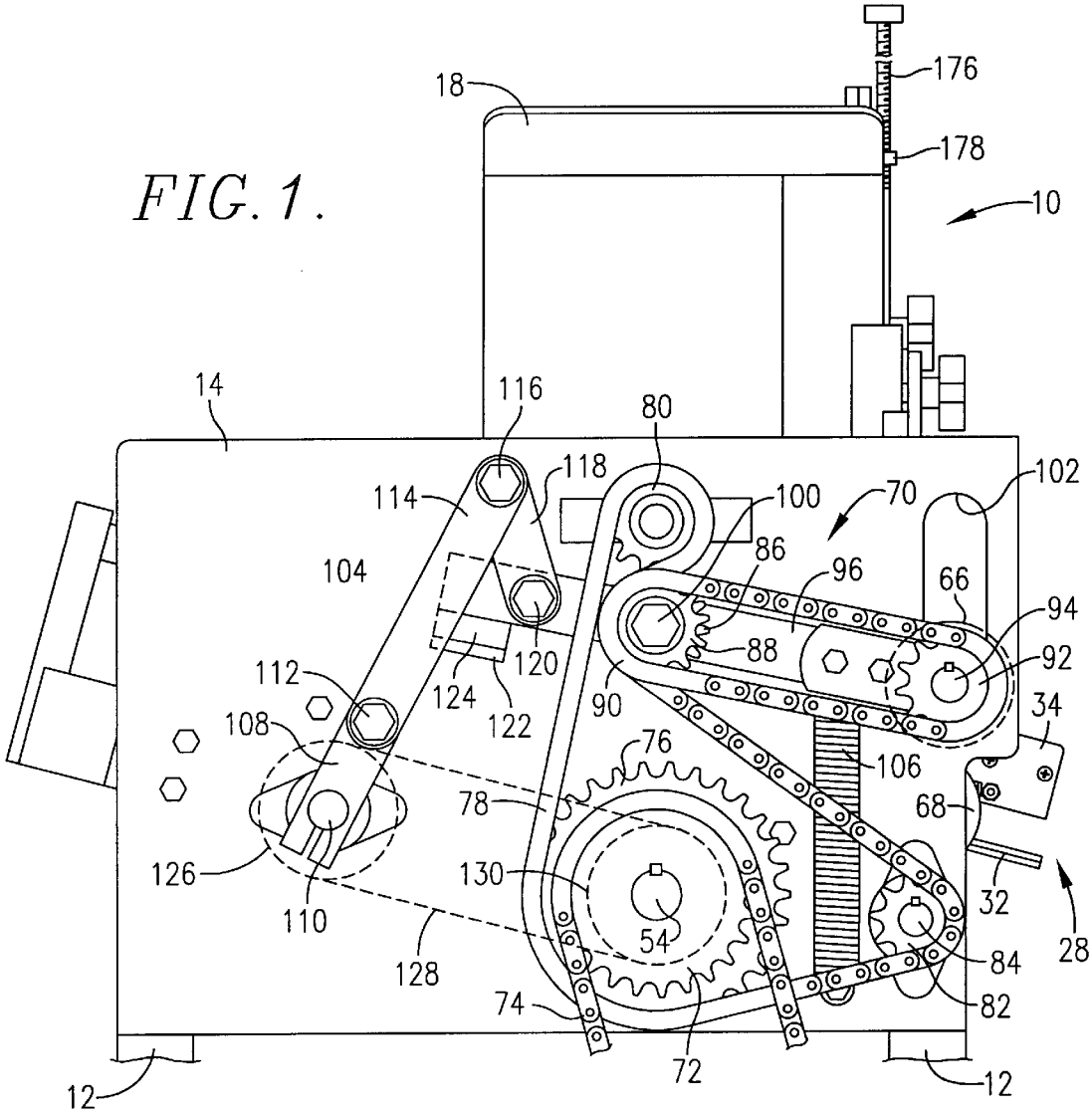
FIG. 1 is a fragmentary side elevational view of a metering hopper incorporating the principles of the present invention.

The hopper 10 has a framework 12 that supports a pair of upright, laterally spaced sidewalls 14 and 16. The sidewalls 14 and 16 are held in place by various members of the framework 12, including a number of transversely extending pieces. The sidewalls serve to define an open top receiving zone for a stack of newspapers or the like, the lateral dimensions of which can be varied through the use of adjustable side plates 18 and 20 located somewhat inboard of the respective sidewalls 14 and 16. The front of the hopper is defined in part by a plurality of upright, rigid straps 22, 24 and 26. The hopper is open across the back.

Figure 2:
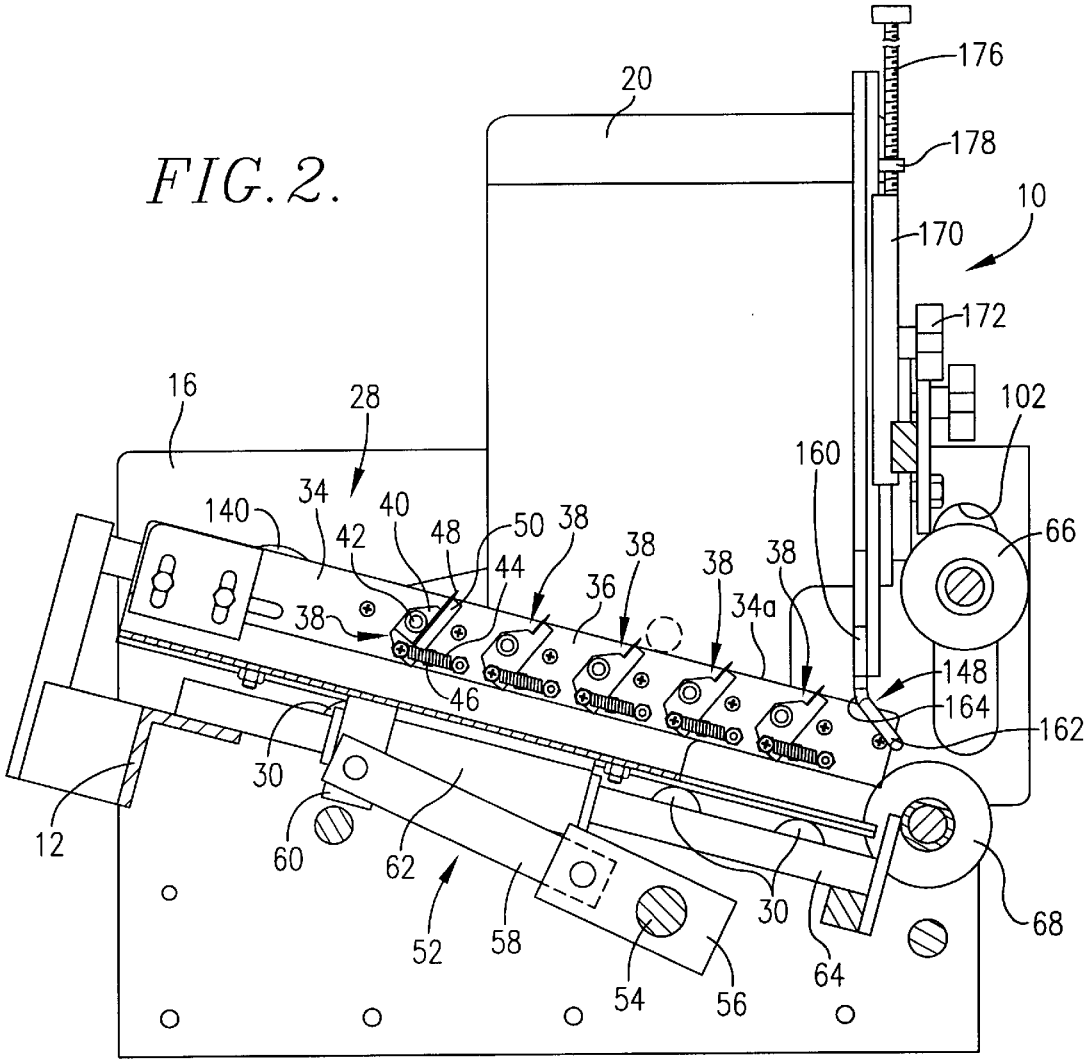
FIG. 2 is a view similar to FIG. 1 but with the near side wall of the hopper removed and parts shown in cross section for clarity, the feed shuttle being illustrated at the rear end of its return stroke.
Figure 3:
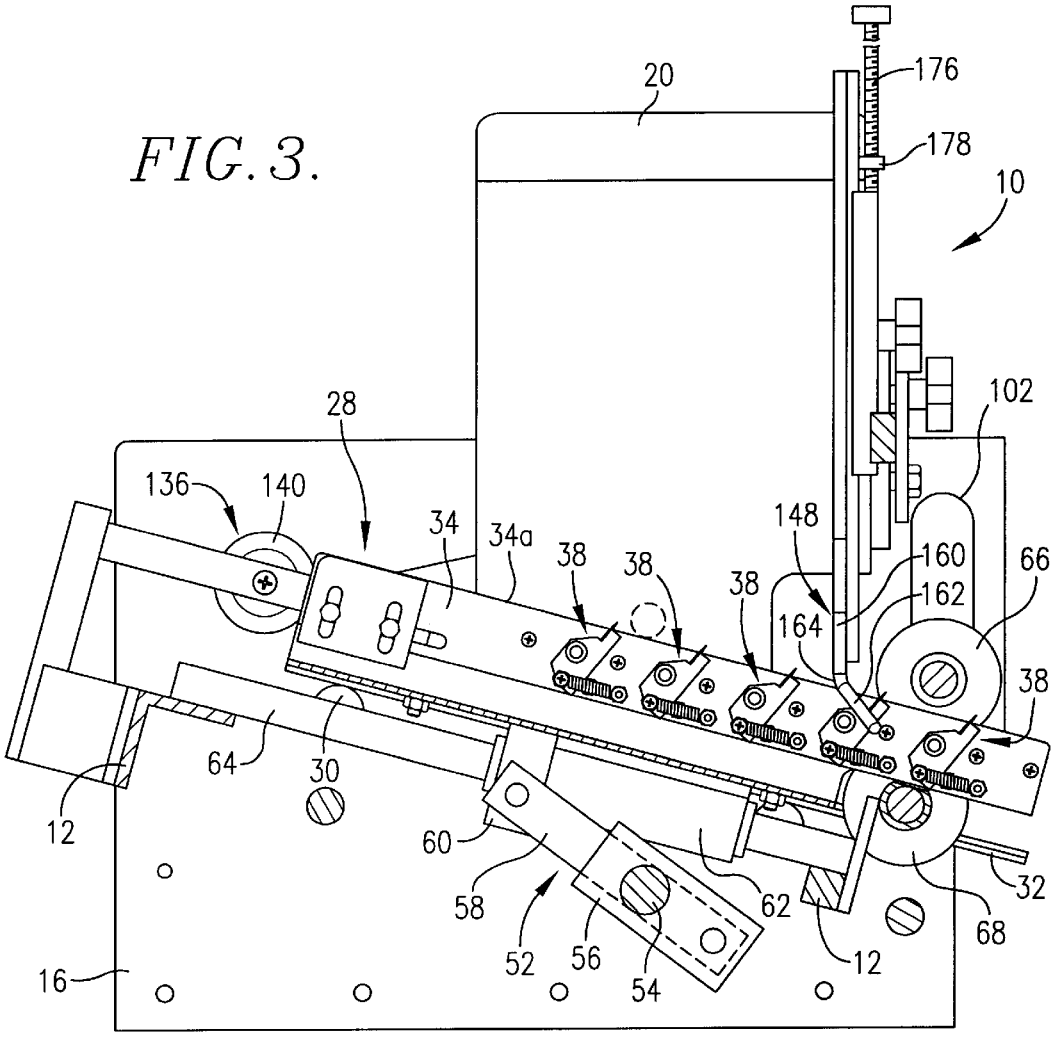
FIG. 3 is a view of the hopper similar to FIG. 2 but showing the feed shuttle at the front end of its feed stroke.

A reciprocable feed shuttle broadly denoted by the numeral 28 defines the floor of the hopper and is supported by a plurality of rollers 30 for movement across the bottom of a stack of newspapers in the hopper through alternate feed and return strokes. The shuttle 28 is somewhat inclined downwardly and forwardly as illustrated in FIGS. 2 and 3, for example, and includes a main flat plate 32 that rides on the rollers 30. In the center of the plate 32, the shuttle 28 has a narrow, fore-and-aft extending support rail 34 that extends over substantially the full fore-and-aft dimension of the plate 32. The support rail 34 includes an upper, rectangular fore-and-aft strip of plastic material 36 whose upper extremity defines an uppermost longitudinal, relatively narrow edge 34*a* of the rail.

A set of five spike units 38 are lined up at spaced intervals along one side of the rail 34 for use in connecting the rail with the lowermost newspaper during the feed stroke of the shuttle. Each of the spike units 38 includes a spike holder 40 that is pivotally attached to the rail by a horizontal pivot 42. Each unit 38 also has a biasing spring 44 anchored to the rail at one extremity and to a bottom corner of the holder at the other extreme so as to yieldably bias the holder in a counterclockwise direction viewing FIGS. 2 and 3. An abutment 46 projecting outwardly from the rail in the vicinity of the spring 44 is engaged by the holder 40 to limit the amount of counterclockwise rotation thereof. Thus, as illustrated in FIGS. 2 and 3, when the holders 40 are in engagement with the abutment 46, spikes 48 of the spike units 38 project angularly upwardly and forwardly to penetrate the lowermost newspaper to a sufficient extent as to securely connect the paper to the support rail 34.

Each of the holders 40 has a depth limiting shoulder 50 that prevents the spike 48 from digging in too deeply into the newspaper. The springs 44 are weak enough to permit the spike units 38 to be forcibly rotated in a clockwise direction against the return action of the springs during return strokes of the feed shuttle as the spikes 48 bear against the underside of the overhead newspaper. As will be seen from the discussion below, the lowermost newspaper is being withdrawn from the shuttle as the shuttle begins its return stroke, and such forward movement of the newspaper also has the effect of rotating the spike units downwardly into a non-penetrating position.

The feed shuttle 28 is reciprocated in its feed and return strokes by drive mechanism broadly denoted by the numeral 52. Drive mechanism 52 includes a transverse, continuously rotating drive shaft 54 having a crank 56 fixed thereto for rotation therewith. The drive mechanism further includes a drive link 58 pivotally connected at one end to the crank 56 and at the other end to a collar 60 fixed to the rear end of a drive sleeve 62. The collar 60 and the sleeve 62 are in turn fixed to the bottom of the main plate 32 of feed shuttle 28. Sleeve 62 receives a fore-and-aft guide rod 64 that is fixed to the framework 12. Thus, rotation of the drive shaft 54 causes reciprocation of the sleeve 62 along the guide rod 64, which results in reciprocation of the feed shuttle 28.

As shown particularly in FIGS. 2 and 3, two pairs of driven nip rollers 66 and 68 are provided at the front of the hopper. The nip rollers 66 and 68 are slightly in front of the stack receiving zone of the hopper so that when the feed shuttle 28 is in its fully retracted position of FIG. 2, the leading edge of the rail 34 is positioned slightly behind the nip rollers 66 and 68 with respect to the direction of feed. However, as shown in FIG. 3, when the feed shuttle 28 is in its forwardmost position, the rail 34 projects forwardly somewhat beyond the upper feed rollers 66 and the lower feed rollers 68.

Figure 4:
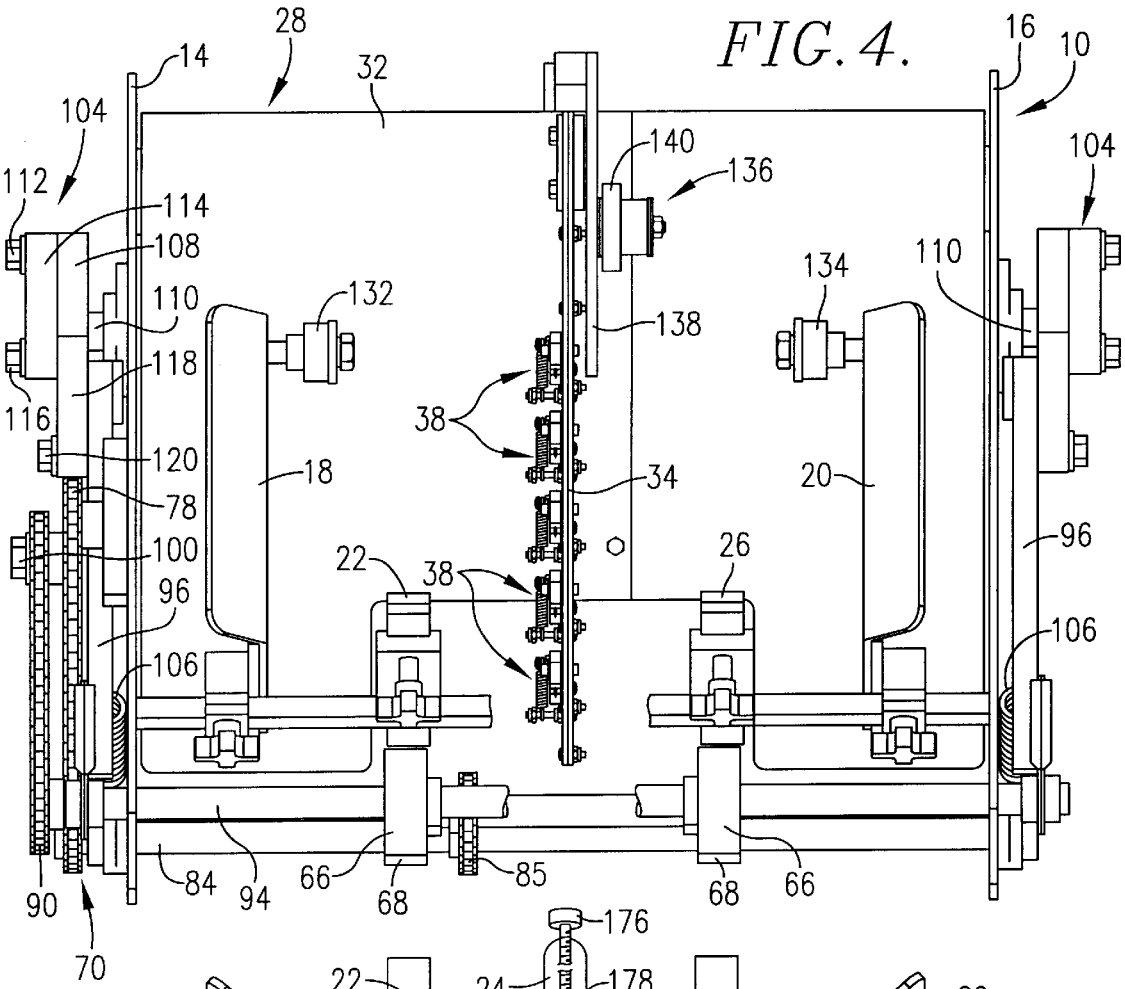
FIG. 4 is a top plan view of the hopper with certain components partially broken away to reveal details of construction.
Figure 7:
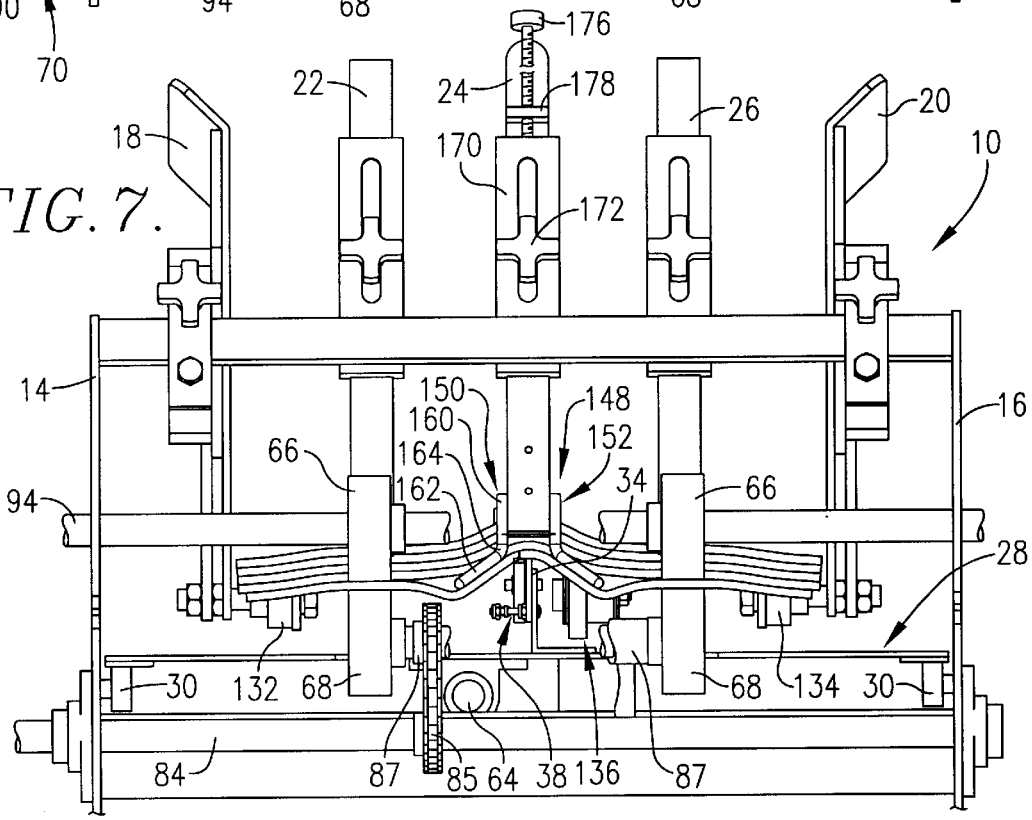
FIG. 7 is similar to FIGS. 5 and 6 but with the feed shuttle near the end of its feed stroke so that the lowermost newspaper is partially ejected from the stack and the nip rollers are clamped down onto the front edge of the paper.

It will also be noted that the upper nip rollers 66 are alternately clamped down against and spaced up away from the lower nip rollers 68. The apparatus for accomplishing such opening and closing of the nip rollers 66 and 68, and for driving the same, is illustrated in FIGS. 1 and 4, and is broadly denoted by the numeral 70. As shown, the apparatus 70 includes a sprocket 72 fixed to the drive shaft 54, such sprocket receiving driving input power and communicating it to the shaft 54 via a chain 74 that leads from a main source of driving power (not shown). A second, larger sprocket 76 is fixed to the shaft 54, which sprocket 76 is entrained by a drive chain 78 looped around an upper idler sprocket 80 and a lower driven sprocket 82 fixed to ajackshaft 84 that spans the sidewalls 14,16 and is supported thereby as shown in FIG. 7. A chain and sprocket assembly 85 (FIG. 7) drivingly connects the jackshaft 84 with the shaft 87 of the lower nip rollers 68.

The apparatus 70 further includes a sprocket 86 (FIG. 1) that is backwrapped by the chain 78. Sprocket 86 is carried on the same shaft as a companion sprocket 88 that is in turn entrained by a fore-and-aft extending endless chain 90. The chain 90 at its front end is looped around a sprocket 92 fixed to the shaft 94 associated with the upper nip rollers 66. Thus, the chain 90 takes driving power from the chain 78 and supplies it to the upper nip rollers 66.

The shaft 94 of the upper nip rollers 66 is carried by a pair of fore-and-aft extending arms 96 on opposite sides of the hopper. Each of the arms 96 can swing up and down for a limited distance about respective horizontal pivots 100, the pivot 100 for the left side of the machine as shown in FIG. 1 being coaxial with the axis of rotation of the sprocket 86 and 88. Vertical clearance slots 102 are provided in the sidewalls 14 and 16 as illustrated in FIG. 1 (only the sidewall 14 being illustrated) to provide room for the shaft 94 to move up and down as the nip rollers 66,68 open and close.

In order to effect the raising and lowering of the arms 96, the apparatus 70 further includes a linkage 104 on each side of the hopper, as well as a pair of return springs 106 on opposite sides of the hopper. The linkages 104 each include a short crank 108 fixed to opposite ends of ajack shaft 110 that extends completely across the back of the hopper and projects outwardly through and beyond the sidewalls 14 and 16. Each crank 108 has a pivot connection 112 with a longer intermediate link 114 that has pivot connection 116 at its upper end with a short link 118. The link 118, in turn, has a pivot connection 120 with the corresponding arm 96 near its rearmost end. The rearmost end of each arm 96 also carries an outturned ledge 122 that projects laterally outwardly from the face of the arm 96 into the path of travel of the short link 118. A rubber cushion 124 is carried on the ledge 122 with an upper surface that substantially coincides with the lower extremity of the arm 96.

The jack shaft 110 has a sprocket 126 (FIG. 1) fixed thereto that is entrained by an endless chain 128 extending forwardly to another sprocket 130 fixed to the drive shaft 54. Thus, the jack shaft 110 receives driving power from the chain 128, and as the jack shaft 110 rotates, the cranks 108 also rotate so that the pivot connection 112 moves in a circular path of travel about the axis of the jack shaft 110. As this occurs, the intermediate link 114 has the effect of alternately pulling down and pushing up on the short link 118. During the down pulling portion of each cycle, the short link 118 comes down into abutting engagement with the cushion 124 on arm 96. As the intermediate link 114 continues toward the mid-point of its cycle, such continued motion thereafter causes the short link 118 to effectively become drivingly engaged with the rear end of the arm 96 through the cushion 124, thus swinging down the rear end of the arm 96 about its pivot 100. Thus, in this part of the cycle, both of the arms 96 become raised at their front ends, opening the nip rollers 66 and 68.

As the pivot connection 112 continues on into the last 180° of its cycle, the intermediate link 114 swings the short link 118 upwardly away from the cushion 124, thus allowing the return spring 106 to pull the front end of the arm 96 downwardly. Consequently, the nip rollers 66 close against the lower nip rollers 68. Due to the timing involved, the nip rollers 66 and 68 are open when the feed shuttle 28 is filly retracted as in FIG. 2 and are closed when the feed shuttle is filly forward as in FIG. 3.

Figure 8:
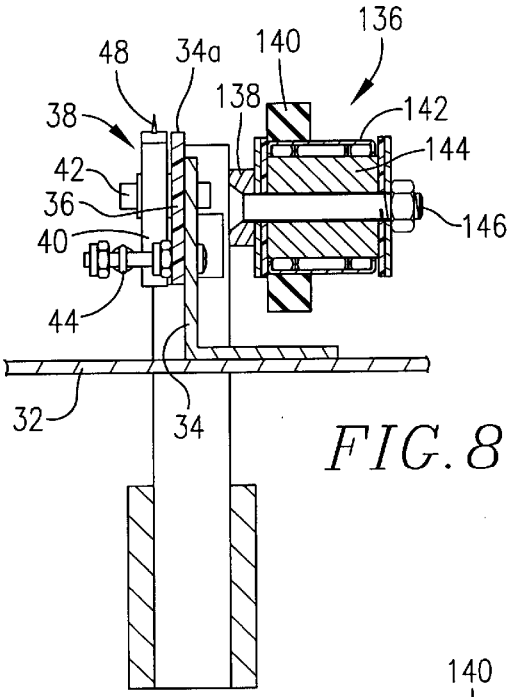
FIG. 8 is an enlarged, fragmentary vertical cross sectional view through the hopper looking rearwardly and illustrating in particular the one way, free wheeling support roller at the back of the hopper.
Figure 9:
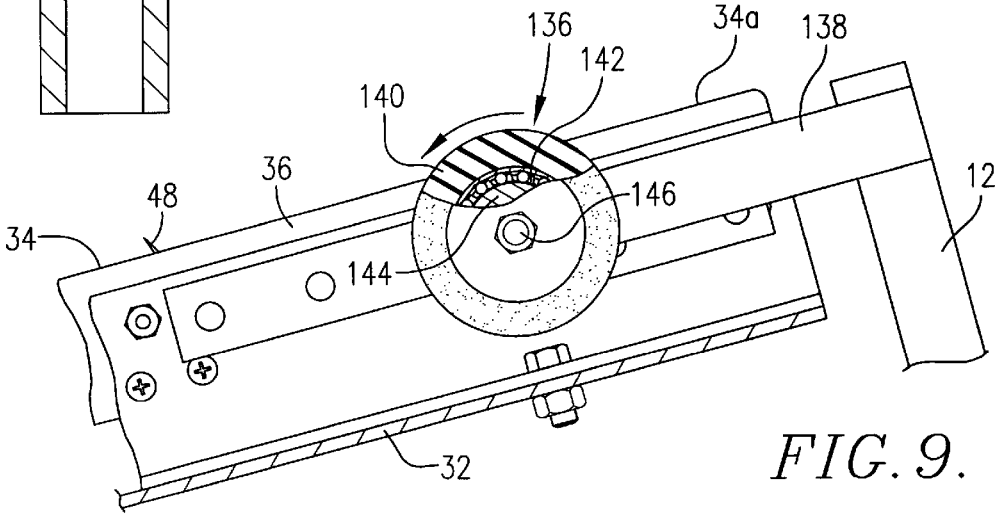
FIG. 9 is a fragmentary side elevational view of the support roller of FIG. 8.

As illustrated perhaps most clearly in FIG. 4, the two side plates 18 and 20 of the hopper carry a pair of free wheeling rollers 132 and 134 respectively that are located to underlie and support the newspaper stack in the area of the rear comers. In addition, in the central rear portion of the hopper, a special one-way free wheeling roller 136 is located beside the path of travel of the support rail 34 in disposition to engage and underlie the central rear extremity of the newspaper stack. As illustrated in detail in FIGS. 8 and 9, the one-way roller 136 is carried by a fore-and-aft extending arm 138 fixed to a portion of the framework 12 at the rear of the hopper. The roller 136 has an outer, annular rim 140 of rubber material or the like that encircles a one-way clutch 142 on a rotatable hub 144 of the wheel. The rim, clutch 142 and hub 144 are adapted to freely rotate about the axis of the mounting bolt 146 that attaches the hub to the arm 138, but such rotation is only in a counterclockwise direction viewing FIG. 9 so that the upper periphery of the wheel 136 rotates generally in the direction of feed in a free-wheeling manner. The clutch 142 precludes rotation of the wheel in a clockwise direction viewing FIG. 9, i.e., in a direction opposite to the direction of feed. As illustrated in FIGS. 8 and 9, the upper periphery of the wheel 136 projects slightly above the upper edge 34*a* of the support rail 34.

Figure 11:
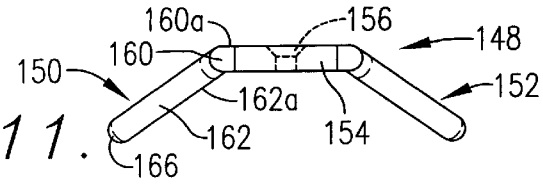
FIG. 11 is a top plan view thereof.
Figure 12:
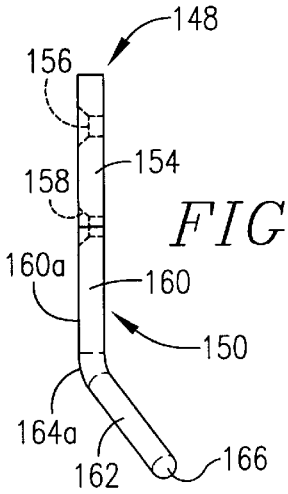
FIG. 12 is a side elevational view thereof showing the generally L-shaped configuration of the dual stop.
Figure 10:
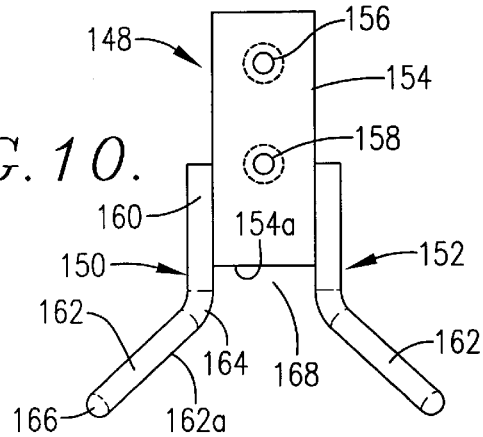
FIG. 10 is an enlarged front elevational view of the preferred dual stop separate for thick, big city newspapers.

The embodiment of the invention disclosed in FIGS. 1–12 utilizes a dual stop separator at the front of the hopper broadly denoted by the numeral 148. The separator 148 is located at the bottom of the center upright strap 24 and is shaped somewhat in the nature of a fork having two prongs. Details of the dual stop separator 148 are illustrated in FIGS. 10–12.

As illustrated in those figures, the separator 148 includes a pair of generally L-shaped stops 150 and 152 that are spaced apart laterally from one another and are fixed to opposite sides of an upright, rectangular mounting plate 154. The mounting plate 154 is adapted to butt up against the backside of the strap 24 and to be secured thereto by machine screws or the like passing through a pair of countersunk holes 156 and 158 in the plate 154.

Using the stop 150 as an example, each stop includes an upright blocking leg 160 and a lower, outwardly and downwardly projecting deflecting leg 162. In addition to projecting forwardly and downwardly from the blocking leg 160, the deflecting leg 162 also angles laterally outwardly and downwardly as shown in FIG. 10, such that the two deflecting legs 162 of the stops 150 and 152 flare outwardly or diverge from one another in the feeding direction of the newspapers.

Each stop 150 and 152 is constructed from a single unitary piece of metal rod having a circular cross section configuration. Thus, the legs 160 and 162 are integrally joined to one another at a bend or knee 164. Preferably, viewing FIG. 10, each deflecting leg 162 projects laterally outwardly from the upright axis of the leg 160 at an approximate 45° angle, while viewing FIG. 12, it will be seen that each deflecting leg 162 projects forwardly from the upright axis of the leg 160 at an approximate 60° angle. The backside of each leg 160 presents a blocking surface 160*a* that faces the front edges of the newspapers within the stack and which has a lower termination 164*a* at the knee 164. Similarly, each deflecting leg 162 has a deflecting surface 162*a* along its inside stretch that generally faces the opposite deflecting leg 162 in disposition for engaging a corresponding side slope of the ridge in the lowermost newspaper as it is ejected from the stack as will hereinafter be explained in more detail. The outermost free end of the deflecting leg 162 terminates in a rounded tip 166.

The stops 150 and 152 are integrally connected to one another by the mounting plate 154. Viewed from the front, as in FIG. 10, it will be seen that the two stops 150,152 and the plate 154 cooperate to yield a somewhat inverted U-shape or V-shape for the separator 148. The bottom edge 154*a* of the mounting plate 154 is spaced a distance above the knees 164 of the stops 150 and 152 so that an open space 168 is defined below the edge 154*a* and between the blocking legs 160. The vertical distance between the bottom edge 154*a* of the plate 154 and the knees 164 of the stops 150,152 should substantially exceed the thickness of the newspapers being fed by the hopper. In the embodiment of FIGS. 1–12, each blocking leg 160 is approximately the same length as each deflecting leg 162.

Figure 5:
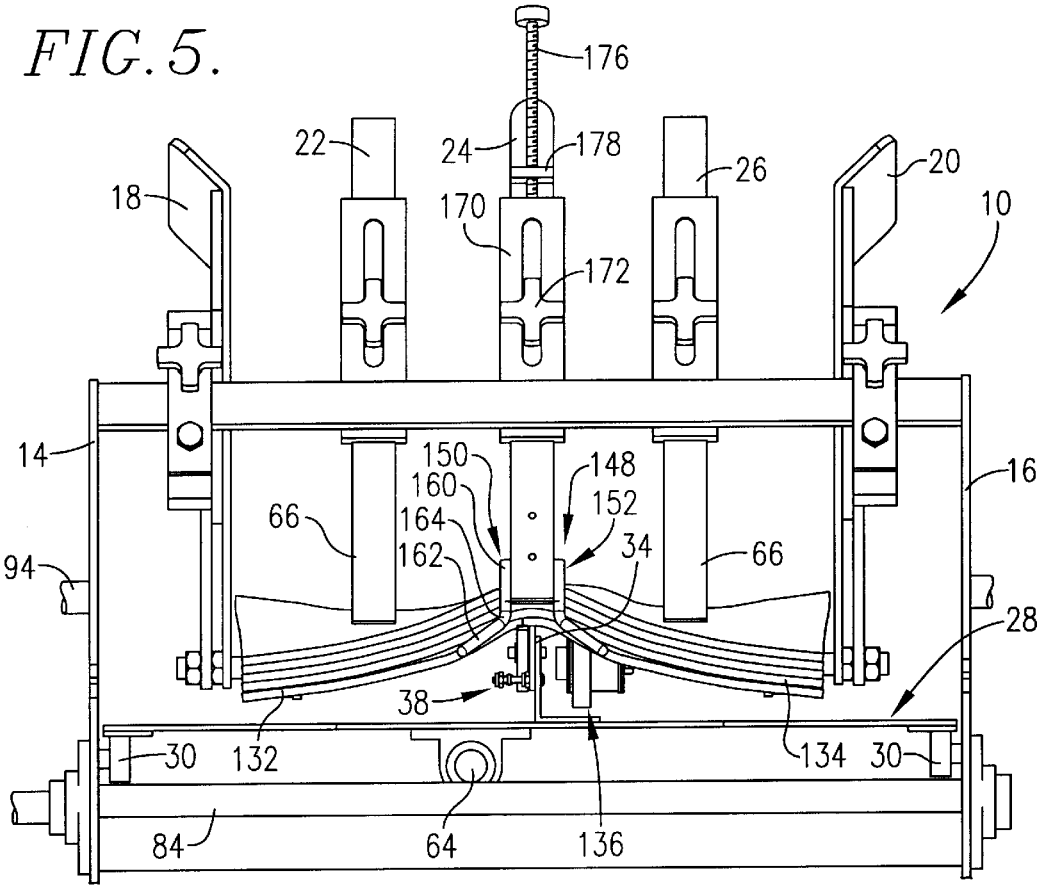
FIG. 5 is a front elevational view of the hopper with the nip rollers removed and illustrating the condition of a short stack of papers in the hopper at the beginning of a feed stroke.
Figure 6:
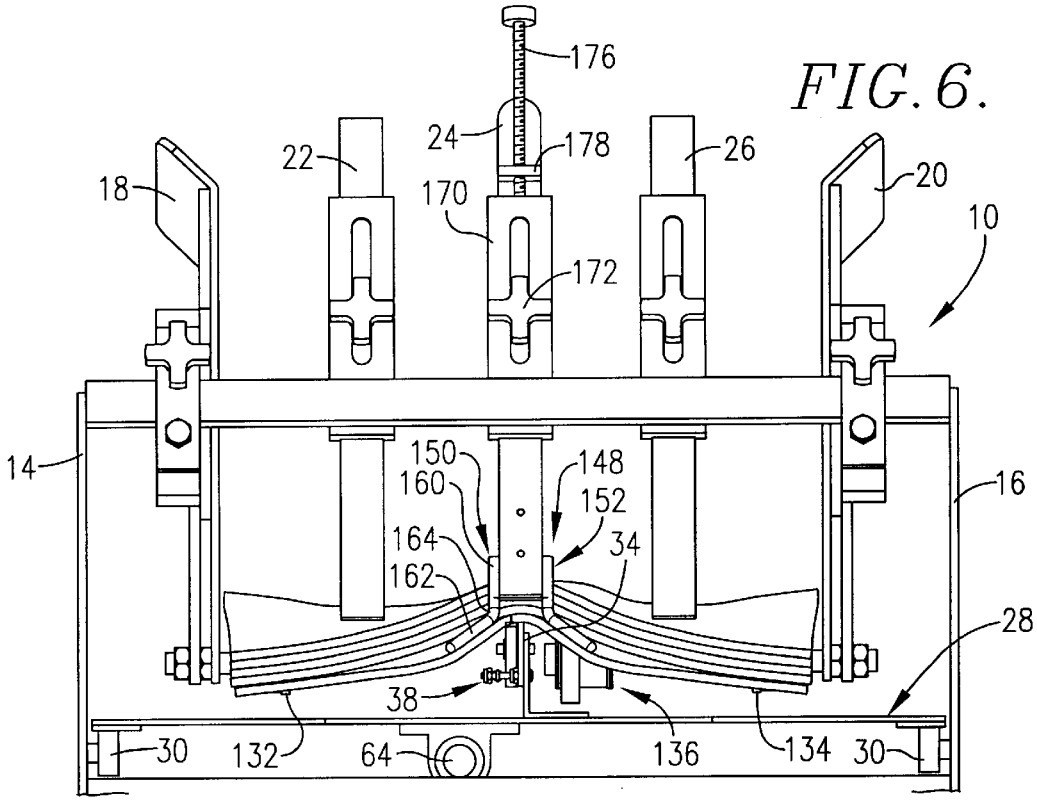
FIG. 6 is similar to FIG. 5 but with the feed shuttle advanced part way through its feed stroke.

As illustrated in FIG. 5, 6 and 7, the dual stop separator 148 is situated symmetrically with respect to the rail 34 so that the two stops 150 and 152 are disposed on opposite sides of the path of travel of the rail 34 in laterally offset relationship to the rail 34. This causes the open space 168 to be disposed directly above the rail 34. The vertical dimension of the space 168 can be adjusted as a result of the fact that the strap 24 on which the separator 148 is mounted is vertically adjustable. To this end, the strap 24 is slidably received within a vertically disposed guide channel 170 so that when a clamping knob assembly 172 is loosened, the strap 24 may be shifted upwardly and downwardly relative to the guide 170 that is fixed to the framework of the hopper. The clamping knob assembly 172 is carried by the strap 24 during its shifting movement and projects through a vertically elongated clearance slot 174 in the guide channel 170. An adjusting screw 176 is threaded into an outwardly projecting tab 178 on the central strap 24 and bears against the top of the guide channel 170 such that rotation of the adjusting screw 176 when the clamp knob 172 is released causes the strap 24 to be incrementally advanced upwardly or downwardly depending upon the direction and extent of rotation of the adjusting screw 176.

OPERATION

FIGS. 5, 6 and 7 are particularly illustrative of the separating action performed by the dual stop separator 148. As illustrated in FIG. 5, when a stack of newspapers is placed within the hopper and laid to rest on the support rail 34, the support rollers 132,134, and the one-way free-wheeling roller 136, a central elongated ridge is formed in the newspapers above the rail 34. The ridge in each newspaper has an uppermost peak that directly overlies the rail 34, and a pair of side slopes that diverge downwardly away from the peak on opposite sides of the rail 34.

The condition of things in FIG. 5 corresponds to the condition illustrated in FIG. 2, i.e., the rail 34 is fully retracted and is ready to begin a feed stroke. The dual stop separator 148 has been adjusted that so that the open space 168 directly above the rail 34 is substantially greater than the thickness of the lowermost newspaper, preferably thicker or taller than the predicted thickness of the thickest rolled up front edge that may be encountered on newspapers being fed. In the position illustrated in FIG. 5, the space is approximately three newspaper sections thick. The knees 164 of the stops 150 and 152 are located in line with the second newspaper in the stack so that the second newspaper and all of those above it are blocked by the blocking legs 160 of the stops, and the rearwardly facing surface of the strap 24, as well as the rearwardly facing surfaces of the straps 22 and 26.

As the feed shuttle 28 begins its forward stroke, the spikes 48 penetrate into the bottom newspaper to lock the newspaper with the rail 34. As the rail 34 then moves forwardly, the lowermost paper moves forwardly with it, and the ridge of the paper starts to pass through the separator 148. The peak of the ridge in the lowermost newspaper is unobstructed as it attempts to move forwardly, and it moves in an unhindered manner through the open space 168. On the other hand, the slide slopes of the lowermost paper begin to contact the deflecting surfaces of the deflecting legs 162 of the stops, causing the side slopes to bend downwardly more completely away from the next overhead newspaper as illustrated in FIG. 6. By the time the feed shuttle reaches its forwardmost position at the end of the feed stroke as illustrated in FIGS. 3 and 7, the side slopes of the paper will have deflected downwardly even further and the nip rollers 66 and 68 will have clamped down onto the leading edge of the paper. Such clamping action by the nip rollers causes the leading edge to be bent down slightly away from the top edge of the rail 34 inasmuch as the point of engagement between the roller 66 and 68 is somewhat lower than the top edge of the rail. Such down bending of the leading edge of the newspaper also assists in the separating or breaking away of the lower newspaper from the next paper in the stack.

Once the nip rollers 66 and 68 have grabbed a hold of the lower newspaper, they quickly begin pulling it off the rail 34 and the rest of the way out of the stack. At the same time, the rail 34 commences its return stroke. This simultaneous forward movement of the lower paper and rearward movement of the rail 34 causes the spike units 38 to rotate clockwise viewing FIGS. 2 and 3 as permitted by the springs 44 such that the spikes do not hinder withdrawal of the paper from the stack by the nip rollers. Additionally, as the rail 34 returns to its full rearward position, the spikes wipe against the bottom of the next newspaper in the stack but do not penetrate the paper at this time. Thus, there is no tendency for the spikes to drive the next newspaper toward the rear as the rail 34 is moving rearwardly. Moreover, the one-way free wheeling roller 136 is helpful in this respect. Inasmuch as the roller 136 can only rotate in a counterclockwise direction viewing FIG. 9, it resists rearward movement of the next newspaper but freely allows forward movement thereof during the feed stroke. Moreover, since the upper periphery of the roller 136 is slightly above the upper edge 34*a* of the rail 34, the wheel 136 tends to hold the back portion of the newspaper slightly above the rail.

The dual stop separator 148 is very forgiving insofar as thickness variations in the newspapers is concerned. For example, if a newspaper with a rolled up front edge is presented to the stop, the rail 34 has no problem in feeding that paper through the two stops 150 and 152 of the separator. Even though the rolled up front edge may be thicker than the distance between the top edge of the rail 34 and the knees 164 of the stops 150 and 152, the central portion of that rolled front edge at the peak of the ridge is aligned with the open space 168 which will be substantially greater in vertical width than the thickness of the rolled up edge. Thus, the rolled up front edge can pass freely through the open space 168. And, as long as the newspaper is flexible enough that the side slopes of the ridge can be deflected down to pass under the deflecting legs 162 of the stops, the mis-shapened newspaper will pass through the separator 148 without hesitation. In the event that the newspaper is particularly thick and resistant to flexure, it may be necessary to adjust the height of the separator 148 accordingly.

ALTERNATIVE EMBODIMENTS

Figure 13:
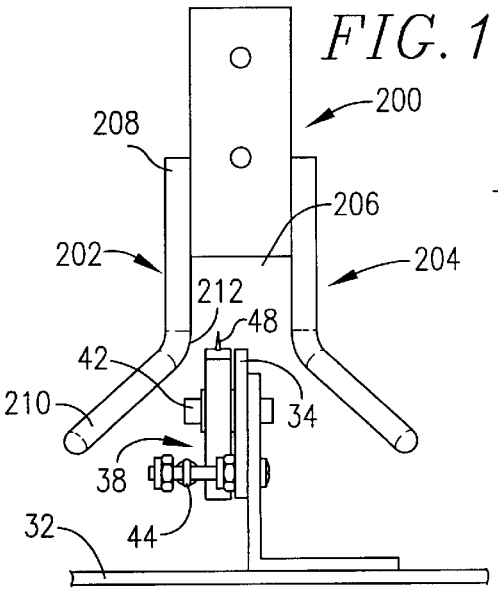
FIG. 13 is an enlarged, fragmentary front elevational view of a second embodiment of a separating stop according to the present invention.

FIG. 13 shows a slightly different configuration for the dual stop separator. In FIG. 13, the dual stop separator 200 is identical to the dual stop separator 148, except that some of the dimensions of the stops 202 and 204, as well as the height of the open space 206, are different from the corresponding dimensions in the separator 148. In this regard, the blocking leg 208 of each stop 202,204 is somewhat longer than the corresponding blocking legs 160 of stops 150 and 152. This permits the open space 206 of the separator 200 to likewise be taller than the corresponding open space 168. This extra height for the open space 206 is helpful in the event that the newspapers are significantly thicker than those illustrated in FIGS. 5, 6 and 7. The deflecting legs 210 of the stops 202 and 204 may remain of the same length as the corresponding deflecting legs 162 of stops 150 and 152.

The action of the newspapers moving through the separator 200 is the same as that with respect to the separator 148, except that with the separator 200 the newspapers will be subjected to less flexing action. Due to the presence of the open space 206 directly above the rail 34, the blocking legs 208 of the stops 202 and 204 prevent newspapers above the lowermost section from moving forwardly with the support rail 34 during the feed stroke. However, there is no downward pressure applied to the peak of the ridge in the newspaper directly above the rail 34 which could otherwise encourage the feeding of doubles, and so long as the side slopes on the ridge of the newspaper can be deflected downwardly by the deflecting legs 210 and passed between the knees 212 of the stops and the rail 34, the newspapers can be readily fed by the rail even if a newspaper with a rolled up front edge is presented. For best results, the open space 206 should not only be substantial taller than the thickness of the lowermost newspaper, but should also be taller than the anticipated thickness of a rolled up front edge. In that way, the rolled up front edge, in the area of the peak in the ridge, can pass readily through the open space 206. The flexibility of the newspaper is not particularly effected by the presence or absence of a rolled up front edge and, thus, allowance simply needs to be made for increased resistance to deflection by newspapers having inserts bunched up in the center of the edge or otherwise providing increased resistance to bending when engaged with the knees 212 and the deflecting legs 210.

Figure 14:
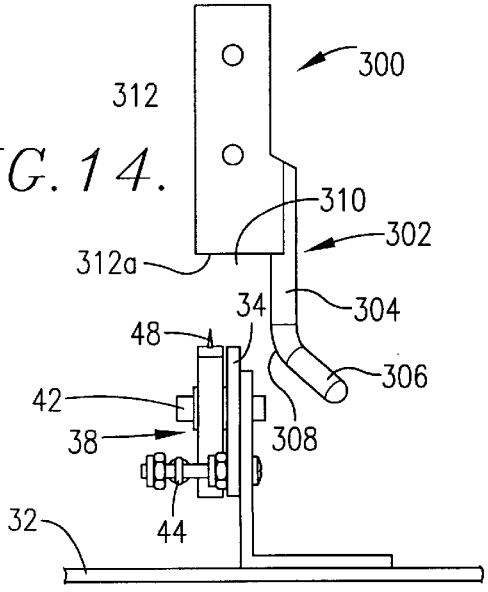
FIG. 14 is an enlarged, fragmentary front elevational view of a third embodiment of the invention in the form of a single stop separator having particular utility for very thin newspaper products.
Figure 16:
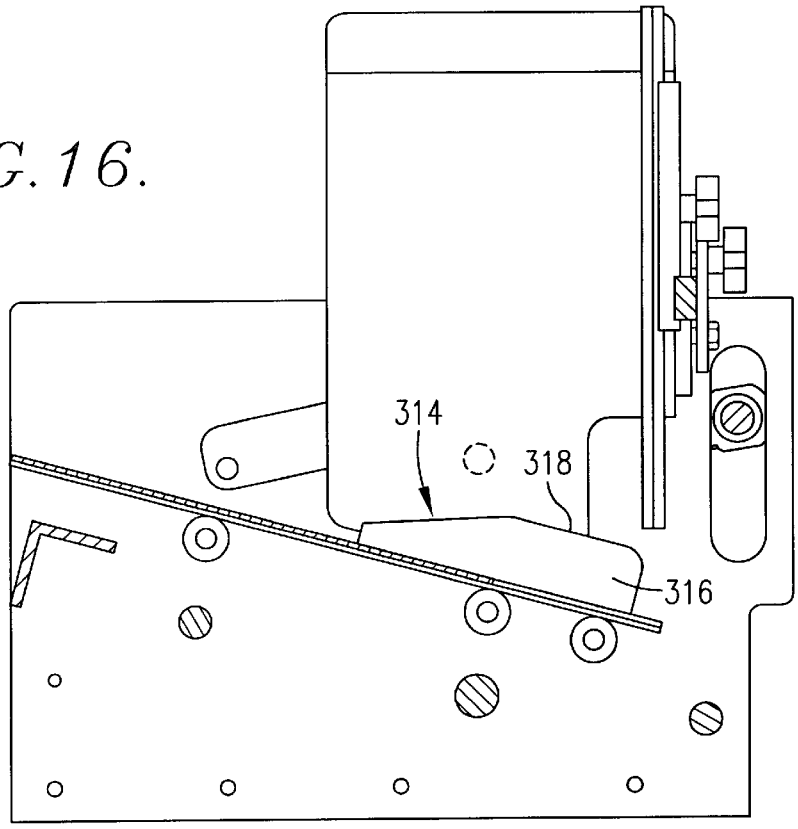
FIG. 16 is a fragmentary, vertical cross-sectional view through the hopper showing the addition of an auxiliary support fin having particular utility for use in connection with the thin newspaper separator of FIGS. 14 and 15.
Figure 15:
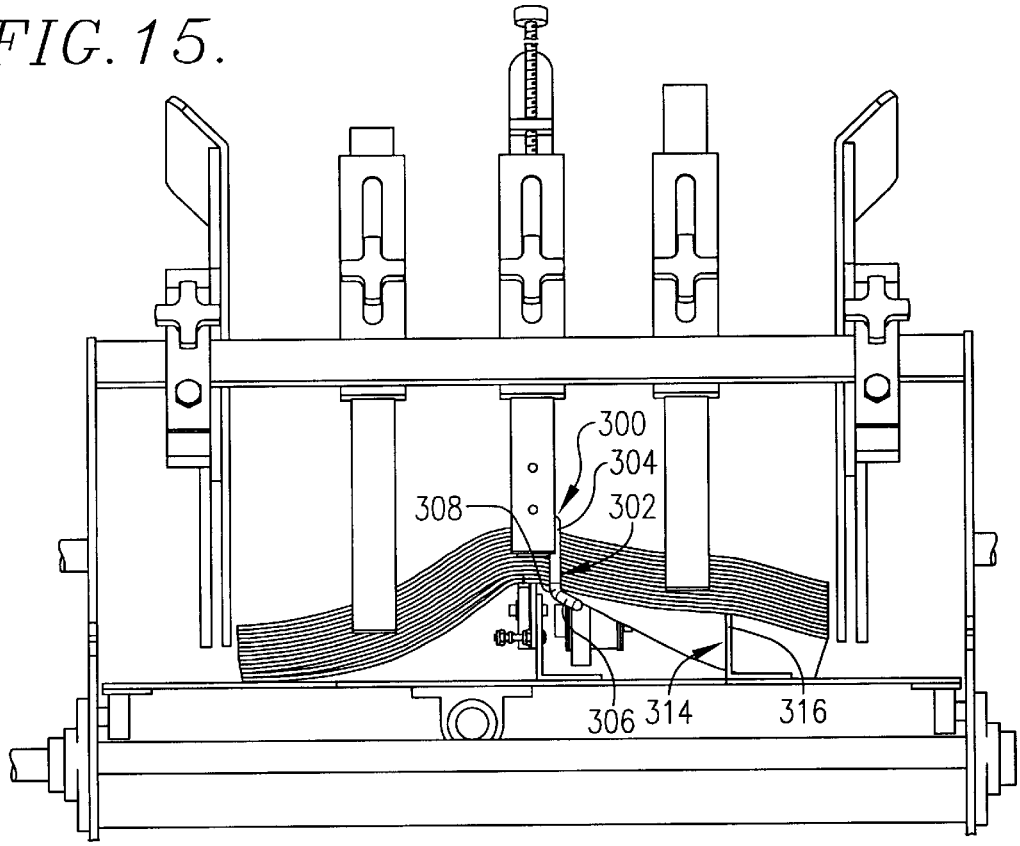
FIG. 15 is a fragmentary front elevational view of the hopper employing the single stop separator of FIG. 14 and illustrating its manner of use with thin newspaper products.

FIGS. 14, 15 and 16 are directed toward a single stop separator that is particularly useful when the newspaper products to be metered are quite thin and flimsy. As shown in FIG. 14 in particular, the single stop separator 300 has a single stop 302 that is offset laterally to one side of the rail 34. As with the previous stops, the stop 302 has an upright blocking leg 304, a downwardly, forwardly and outwardly angled deflecting leg 306, and a rounded knee 308 between the legs 304 and 306. The knee 308 is located at the lower termination of a rearwardly facing blocking surface of the leg 304 and at the commencement of the deflecting surface of the leg 306. Due to the fact that the stop 302 is laterally offset from the rail 34, an open space 310 is defined directly above the rail 34, beside the blocking leg 304 and beneath the lower edge 312*a* of the mounting plate 312 of the separator 300.

In the feeding of flimsy newspapers such as those illustrated in FIG. 15, the use of a stiffening ridge in the body of such papers is particularly important. However, because of their inherent flimsiness, the newspapers also have a tendency to droop down so completely when the ridge is formed that the side slopes of more than one newspaper can fit between the stop 302 and the rail 34. Consequently, as shown in FIGS. 15 and 16, while it is helpful to maintain the droop of the newspapers on one side of the rail 34 so as to achieve some semblance of a stiffening ridge, it is helpful on the other side of the rail, where the stop 302 is located, to keep the leading edges of the newspapers fairly level.

This is achieved through the use of an auxiliary support 314 fixed to the plate 32 of shuttle 28 for reciprocation therewith. The support 314 is generally L-shaped in cross sectional configuration and presents an upstanding, fore-and-aft extending fin 316 that is spaced laterally outwardly from the rail 34 and the stop 302. The fin 316 has an uppermost edge 318 that extends generally parallel to the plate of the shuttle for the front half of the fin 316, and then slopes downwardly and rearwardly for the rear half. The edge 318 is disposed to engage the bottom surface of the lowermost newspaper, and in its front portion is disposed at a slightly lower level than the upper edge of the rail 34. Thus, the lowermost surface of the lower newspaper extends generally parallel to the plate 32 of the shuttle for a short distance rearwardly from the leading edge of the newspaper, and then slopes downwardly and rearwardly until the rear extremity of the fin 316 is reached, whereupon it rides directly against the shuttle plate. The fin 316 terminates at its rear end slightly forwardly of the fore-and-aft midpoint of the shuttle plate. In the case of the feeding of relatively thin newspapers, it has also been found beneficial to completely remove the rear rollers 132 and 134 from the side plates 18 and 20, although the one-way free wheeling roller 136 is still used.

As illustrated in FIG. 15, the single stop separator 300 is adjusted vertically into such a position that the open space 310 immediately above the rail 34 is substantially taller than the thickness of the lowermost newspaper product. With the knee 308 of the stop 302 positioned low enough that it is at or below that portion of the next higher newspaper in the stack directly behind it, each successive lowermost newspaper can be fed by the rail 34 outwardly past the stop 302 and into the awaiting nip rollers. As the front edge of the ejecting lowermost newspaper engages the deflecting leg 306 of the stop 302, the newspaper deflects downwardly under the leg 306 to breakaway cleanly from the next overhead newspaper. Due to the absence of downward pressure from the stop 302 against the newspapers and the rail 34, there is a reduced tendency to feed doubles and triples of the thin products. Yet, if the front edge of one of the products should be rolled up and enlarged for any reason, such product can still be fed out of the hopper without malfunction.

Figure 17:
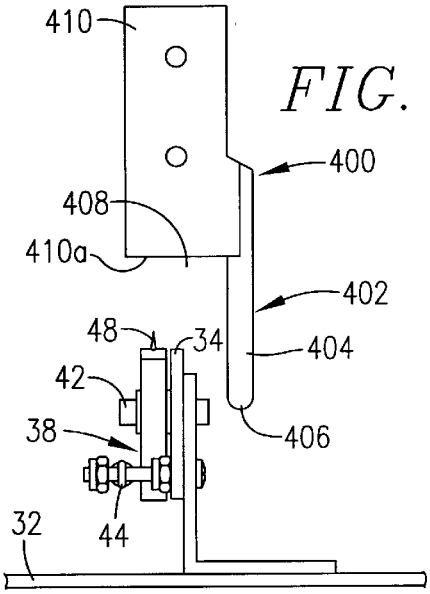
FIG. 17 is an enlarged, fragmentary front elevational view of a fourth embodiment of the invention.

FIG. 17 illustrates another embodiment of a single stop separator which is less preferred than the separator 300, but which may provide satisfactory results under some conditions. The separator 400 of FIG. 17 has a single stop 402 that is offset laterally from the rail 34 and has only an upright blocking leg 404 without a deflecting leg. The lower termination 406 of the blocking leg 404 is rounded but does not bend forwardly as do the knees in the stops of the previous embodiments. Due to the laterally offset nature of the stop 402, an open space 408 is defined above the rail 34, beside the stop 402 and beneath the bottom edge 410a of the mounting plate 410.

Figure 18:
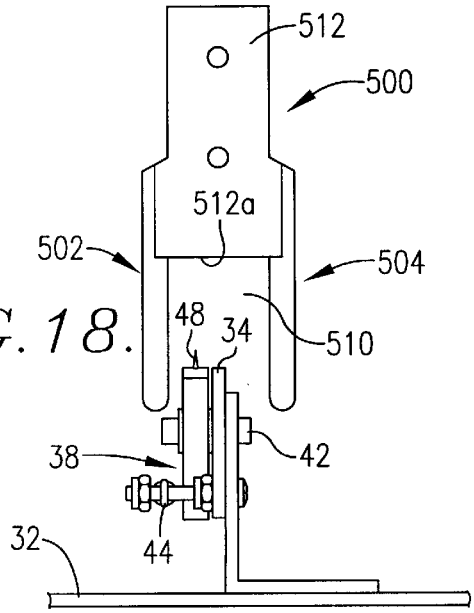
FIG. 18 is an enlarged, fragmentary front elevational view of a fifth embodiment of the invention.

FIG. 18 illustrates a dual stop separator 500 having two stops 502 and 504 that are provided with upright blocking legs 506 only and no deflecting legs. The terminations 508 of the lower ends of the blocking legs 506 are rounded but do noted forwardly in the nature of knees as in certain of the other embodiments. A relieved, open space 510 is defined above the rail 34, between the blocking legs 506, and beneath the lower edge 512a of the mounting plate 512.

Figure 19:
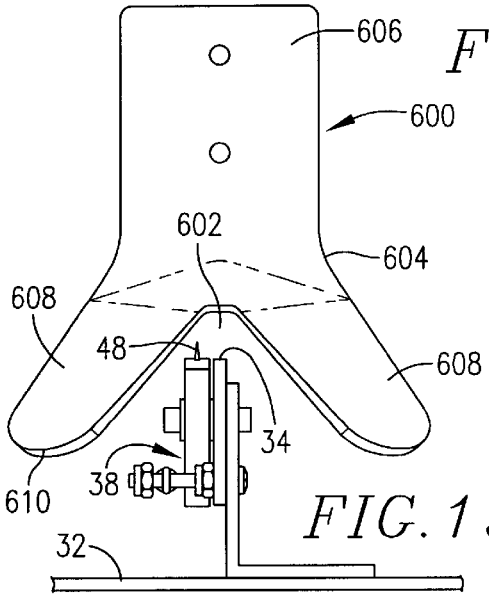
FIG. 19 is an enlarged, fragmentary front elevational view of a sixth embodiment of the invention.
Figure 20:
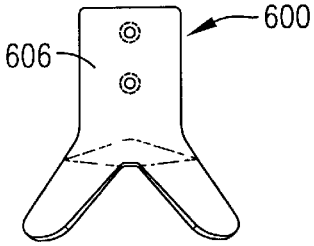
FIG. 20 is a front elevational view of the separator of FIG. 19.
Figure 21:
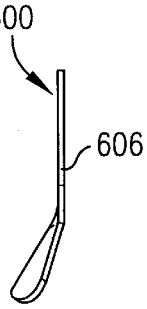
FIG. 21 is a left side elevational view of the separator of FIG. 19.

FIGS. 19, 20 and 21 show another form of dual stop separator made from flat plate material instead of rod stock as in the prior embodiments. The dual stop separator 600 of FIGS. 19–21 also differs from certain of the prior embodiments in that the open space 602 directly above the rail 34 is located below what may be termed a bend or knee 604 in the device. In this respect, the mounting plate and upright blocking face of the separator 600 are integrated into one another so as to present an upright blocking leg 606 that is actually centered above the rail 34 and is symmetrical therewith. The separator plate is bent outwardly at the knee 604 and has a generally inverted V-shaped cutout at its lower front edge, the apex of which defines the open space 602. A pair of deflecting legs 608 project downwardly, forwardly and laterally outwardly from the knee 604 on opposite sides of the rail 34 and are twisted outwardly about their longitudinal axes to a slight extent. The tips 610 of the deflecting legs 608 are rounded.

Although the plate-like separator 600 of FIGS. 19–21 is capable of performing the separation of successive lowermost newspapers in the stack from those above it, this particular embodiment has been found to be less preferred than the embodiment disclosed in FIGS. 1–12, for example. The open space 602 prevents a pinching or clamping pressure against the ridge of the newspapers as in prior embodiments, but the plate-like separator 600 seems to be less forgiving of those occasional newspapers having fat, rolled-up front edges.

Figure 22:
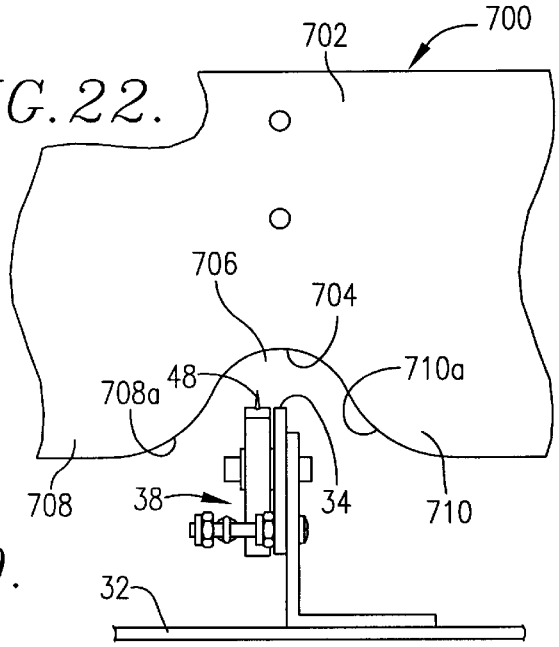
FIG. 22 is an enlarged, fragmentary front elevational view of a seventh embodiment of the invention.

FIG. 22 illustrates another embodiment of a separator utilizing certain principles of the present invention. The separator 700 of FIG. 22 comprises a plate 702 that extends for a distance across the hopper in the central region thereof. The plate 702 is entirely within a single vertical plane, although the plate may be curled up slightly along its lower extremity if desired. A notch 704 along the lower extremity of the plate directly above the rail 34 serves to define an open space 706, and the neighboring lower portions of the plate 702 on opposite sides of the space 706 serve to define blocking stops 708 and 710. The stops 708 and 710 are laterally offset from the rail 34 so that the peak of the ridge of the lowermost newspaper passes through the open space 706 and the side slopes of the ridge are deflected downwardly under the lower terminations 708*a* and 710*a* of the stops 708 and 710.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the doctrine of equivalents to determine and assess the reasonably fair scope of the present invention as pertains to any apparatus not materially departing from but outside the literal scope of the invention as set forth in the following claims.

What is claimed is:

1. In a bottom feed metering hopper for newspapers, the improvement comprising:

a feed shuttle adapted to underlie a stack of newspapers placed in the hopper;

mechanism operably coupled with the shuttle for reciprocating the shuttle across the bottom of the stack in alternating feed and return strokes, said shuttle including an elongated, raised support extending in the feeding direction and disposed to press upwardly against the lowermost newspaper in the stack so as to produce a fore-and-aft stiffening ridge in the lowermost newspaper and other newspapers of the stack, said ridge having a peak aligned vertically with the support, said support being sufficiently connectable with the ridge in the lowermost newspaper during each feed stroke of the shuttle as to drive the lowermost newspaper forwardly with the shuttle in the feeding direction; and a downwardly extending, rigid separating stop at the front of the hopper for blocking newspapers above the lowermost newspaper in the stack from being fed forwardly with the shuttle during its feed stroke, said stop being offset to one side of the path of travel of the support so that an open space is presented beside the stop and directly above the support, said stop including a generally upright blocking surface having a lower termination, said stop being vertically adjustable relative to the support into such a position that the height of the open space substantially exceeds the thickness of the lowermost newspaper, and the termination of the blocking surface is disposed low enough that the surface blocks forward movement ofnewspapers above the lowermost newspaper without also blocking the lowermost newspaper, said shuttle being devoid of raised support structure for the lowermost newspaper below and in lateral alignment with the stop to avoid the formation of a restricted metering slot beneath the stop through which the lowermost newspaper must pass to leave the hopper.

2. In a bottom feed metering hopper as claimed in claim 1, said stop having a downwardly and forwardly inclined deflecting surface extending forwardly from said termination of the blocking surface with respect to the feeding direction.

3. In a bottom feed metering hopper as claimed in claim 2, said deflecting surface being angled laterally outwardly away from said termination of the blocking surface.

4. In a bottom feed metering hopper as claimed in claim 3, said improvement further comprising:

a second support on one side of the first-mentioned support and spaced laterally from the first-mentioned support in disposition for underlying the leading edge of the lowermost newspaper to resist sagging of the newspapers downwardly away from the peak in the ridge, said second support having an upper support surface disposed at a level above the termination of said blocking surface but lower than the upper edge of the first-mentioned support, said stop being located on the same side of the first-mentioned support as said second support.

5. In a bottom feed metering hopper as claimed in claim 3, said improvement further comprising:

a pair of driven nip rollers spaced forwardly from the stop with respect to the feeding direction of the newspapers for receiving the leading edge of each lowermost newspaper from the shuttle during each feed stroke and for pulling the newspaper the rest of the way from the stack.

6. In a bottom feed metering hopper as claimed in claim 5, said support having a top edge, the nip of said rollers being positioned below said top edge of the support such that the nip rollers bend the leading edge of the newspaper downwardly relative to trailing portions of the newspaper as the nip rollers pull the newspaper from the stack.

7. In a bottom feed metering hopper as claimed in claim 1, said improvement further comprising:

a second downwardly projecting, rigid separating stop at the front of the hopper offset to the opposite side of the path of travel of the support from the first-mentioned stop, said second stop including a generally upright blocking surface having a lower termination, said second stop being vertically adjustable relative to the support into such a position that the height of the open space substantially exceeds the thickness of the lowermost newspaper, and the termination of the blocking surface of the second stop is disposed low enough that it blocks forward movement of newspapers above the lowermost newspaper without also blocking the lowermost newspaper.

8. In a bottom feed metering hopper as claimed in claim 7, said stops being rigidly interconnected to one another above the support and above said open space for adjustment in unison.

9. In a bottom feed metering hopper as claimed in claim 8, said stops each having a downwardly and forwardly inclined deflecting surface extending forwardly from said termination of the blocking surface with respect to the feeding direction.

10. In a bottom feed metering hopper as claimed in claim 9, said deflecting surface of each stop being angled laterally outwardly away from said lower termination of the blocking surface so that the deflecting surfaces of the two stops diverge laterally outwardly and downwardly from one another in the feeding direction.

11. In a bottom feed metering hopper as claimed in claim 10, said improvement further comprising:

a pair of driven nip rollers spaced forwardly from the stops with respect to the feeding direction of the newspapers for receiving the leading edge of each lowermost newspaper from the shuttle during each feed stroke and for pulling the newspaper the rest of the way from the stack.

12. In a bottom feed metering hopper as claimed in claim 11, said support having a top edge, the nip of said rollers being positioned below said top edge of the support such that the nip rollers bend the leading edge of the newspaper downwardly relative to trailing portions of the newspaper as the nip rollers pull the newspaper from the stack.

13. In a bottom feed metering hopper as claimed in claim 1, said improvement further comprising:

a pair of driven nip rollers spaced forwardly from the stop with respect to the feeding direction of the newspapers for receiving the leading edge of each lowermost newspaper from the shuttle during each feed stroke and for pulling the newspaper the rest of the way from the stack.

14. In a bottom feed metering hopper as claimed in claim 13, said support having a top edge, the nip of said rollers being positioned below said top edge of the support such that the nip rollers bend the leading edge of the newspaper downwardly relative to trailing portions of the newspaper as the nip rollers pull the newspaper from the stack.

15. In a bottom feed newspaper hopper as claimed in claim 1, said support including a plurality of upwardly and forwardly inclined spikes disposed for penetrating the bottom surface of the lowermost newspaper during the feed stroke of the shuttle to assure positive, driving engagement between the support and the lowermost newspaper, said spikes being retractable by the bottom surface of the next newspaper in the stack during the return stroke of the shuttle.

16. In a bottom feed newspaper hopper as claimed in claim 1, said hopper having a pair of support rollers on opposite sides of the support and spaced laterally outwardly therefrom in position for underlying and supporting outer, rear portions of the stack of newspapers.

17. In a bottom feed newspaper hopper as claimed in claim 1, said support being disposed to engage the lowermost newspaper substantially midway between opposite lateral extremities of the newspaper.

18. In a bottom feed metering hopper for newspapers, the improvement comprising:

a feed shuttle adapted to underlie a stack of newspapers placed in the hopper;

mechanism operably coupled with the shuttle for reciprocating the shuttle across the bottom of the stack in alternating feed and return strokes, said shuttle including an elongated. raised support extending in the feeding direction and disposed to press upwardly against the lowermost newspaper in the stack so as to produce a fore-and-aft stiffening ridge in the lowermost newspaper and other newspapers of the stack, said ridge having a peak aligned vertically with the support, said support being sufficiently connectable with the ridge in the lowermost newspaper during each feed stroke of the shuttle as to drive the lowermost newspaper forwardly with the shuttle in the feeding direction; and a downwardly extending, rigid separating stop at the front of the hopper for blocking newspapers above the lowermost newspaper in the stack from being fed forwardly with the shuttle during its feed stroke, said stop being offset to one side of the path of travel of the support so that an open space is presented beside the stop and directly above the support, said stop including a generally upright blocking surface having a lower termination, said stop being vertically adjustable relative to the support into such a position that the height of the open space substantially exceeds the thickness of the lowermost newspaper, and the termination of the blocking surface is disposed low enough that the surface blocks forward movement of newspapers above the lowermost newspaper without also blocking the lowermost newspaper, said stop being generally L-shaped in side elevation, having a generally upright leg presenting said blocking surface and a generally forwardly projecting leg presenting a deflecting surface, said legs having an intersection with one another at said termination of the blocking surface, said intersection between the legs of the stop comprising a rounded bend in the stop.

19. In a bottom feed metering hopper as claimed in claim 18, said legs of the stop being circular in cross-sectional configuration.

20. In a bottom feed metering hopper as claimed in claim 19, said forwardly projecting leg having a rounded distal tip.

21. In a bottom feed metering hopper as claimed in claim 18, said stop being constructed from a flat plate.

22. In a bottom feed metering hopper as claimed in claim 21, said forwardly projecting leg having a rounded distal tip.

23. In a bottom feed metering hopper as claimed in claim 18, said improvement further comprising:

a pair of driven nip rollers spaced forwardly from the stop with respect to the feeding direction of the newspapers for receiving the leading edge of each lowermost newspaper from the shuttle during each feed stroke and for pulling the newspaper the rest of the way from the stack.

24. In a bottom feed metering hopper for newspapers, the improvement comprising:

a feed shuttle adapted to underlie a stack of newspapers placed in the hopper;

mechanism operably coupled with the shuttle for reciprocating the shuttle across the bottom of the stack in alternating feed and return strokes, said shuttle including an elongated, raised support extending in the feeding direction and disposed to press upwardly against the lowermost newspaper in the stack so as to produce a fore-and-aft stiffening ridge in the lowermost newspaper and other newspapers of the stack, said ridge having a peak aligned vertically with the support, said support being sufficiently connectable with the ridge in the lowermost newspaper during each feed stroke of the shuttle as to drive the lowermost newspaper forwardly with the shuttle in the feeding direction, and a downwardly extending, rigid separating stop at the front of the hopper for blocking newspapers above the lowermost newspaper in the stack from being fed forwardly with the shuttle during its feed stroke, said stop being offset to one side of the path of travel of the support so that an open space is presented beside the stop and directly above the support, said stop including a generally upright blocking surface having a lower termination, said stop being vertically adjustable relative to the support into such a position that the height of the open space substantially exceeds the thickness of the lowermost newspaper, and the termination of the blocking surface is disposed low enough that the surface blocks forward movement ofnewspapers above the lowermost newspaper without also blocking the lowermost newspaper, said hopper having a free-wheeling one-way roller adjacent the support in position for underlying and supporting a rear portion of the stack of newspapers, said one-way roller having an upper periphery disposed at substantially the same height as a top edge of said support and being rotatable only in a direction in which said upper periphery moves in the feeding direction.

25. In a method of feeding newspapers at a metered rate of delivery one-at-a-time, the improvement comprising:

placing the newspapers in an upright stack;

resting the stack at least in part on the upper edge of a relatively narrow, elongated support extending in a fore-and-aft direction with respect to the direction of feed to form a fore-and-aft stiffening ridge in newspapers of the stack, said stiffening ridge having a peak aligned vertically with the support;

retaining the stack at the front with a downwardly projecting rigid stop that is offset to one side of the path of travel of the support so that an open space is presented beside the stop and directly above the support, said stop having a generally upright blocking surface, said blocking surface having a lower termination;

leaving the lowermost newspaper unsupported below and in lateral alignment with the stop to avoid the formation of a restricted metering slot beneath the stop through which the lowermost newspaper must pass to leave the hopper;

positioning the stop with respect to the support such that the height of the open space substantially exceeds the thickness of the lowermost newspaper, and the termination of the blocking surface is disposed low enough that the surface blocks forward movement of newspapers above the lowermost newspaper without also blocking the lowermost newspaper;

reciprocating the support in the feeding direction in alternating feed and return strokes past the stop; and sufficiently connecting the stiffening ridge of each successive lowermost newspaper with the support during its feed stroke such that the lowermost newspaper is driven forwardly with the support in the feeding direction and ejected at least partially from the stack.

26. In a method of feeding newspapers as claimed in claim 25, gripping the partially ejected lowermost newspaper by its leading edge before the support begins its return stroke and pulling the partially ejected newspaper the rest of the way out of the stack; and maintaining each successive lowermost newspaper sufficiently disconnected from the support during its return stroke as to keep the support from interfering with pulling of the newspaper from the stack.

27. In a method of feeding newspapers as claimed in claim 25, said support being located substantially midway between opposite lateral extremities of the lowermost newspaper.

28. In a method of feeding newspapers as claimed in claim 25, said step of sufficiently connecting the support with each successive lowermost newspaper including the step of penetrating the lowermost newspaper with a plurality of spikes associated with the support.

29. In a method of feeding newspapers as claimed in claim 20, said improvement further comprising:

engaging the lowermost newspaper with a downwardly, forwardly, and laterally outwardly inclined deflecting surface generally forwardly in line with the blocking surface as the lowermost newspaper is being driven forwardly by the support.

30. In a method of feeding newspapers as claimed in claim 29, said improvement further comprising:

supporting the leading edge of the lowermost newspaper with a second support on one side of the first-mentioned support and at a location spaced laterally from the first-mentioned support, said second support having a supporting surface that is disposed at a level higher than said termination of the blocking surface but lower than the upper edge of the first-mentioned support.

31. In a method of feeding newspapers as claimed in claim 25, said step of resting the stack at least partially on a support to form a ridge including the step of forming a pair of side slopes in the newspapers that generally incline downwardly from the peak of the ridge on opposite sides of the support;

retaining the stack at the front with a second downwardly projecting rigid stop that is offset to the opposite side of the path of travel of the support from the first-mentioned stop, said stops being disposed in generally fore-and-aft alignment with the side slopes of the ridge, said second stop including a generally upright blocking surface having a lower termination; and positioning the second stop with respect to the support such that the height of the open space substantially exceeds the thickness of the lowermost newspaper, and the termination of the blocking surface of the second stop is disposed low enough that the surface blocks forward movement of newspapers above the lowermost newspaper without also blocking the lowermost newspaper.

32. In a method of feeding newspapers as claimed in claim 31, said improvement further comprising:

engaging the slopes of the lowermost newspaper with a pair of downwardly, forwardly, and laterally outwardly inclined, diverging deflecting surfaces as the lowermost newspaper is being driven forwardly by the support.

33. In a method of feeding newspapers as claimed in claim 32, gripping the partially ejected lowermost newspaper by its leading edge before the support begins its return stroke and pulling the partially ejected newspaper the rest of the way out of the stack; and maintaining each successive lowermost newspaper sufficiently disconnected from the support during its return stroke as to keep the support from interfering with pulling of the newspaper from the stack.

34. In a bottom feed metering hopper for newspapers, the improvement comprising:

a feed shuttle adapted to underlie a stack of newspapers placed in the hopper;

mechanism operably coupled with the shuttle for reciprocating the shuttle across the bottom of the stack in alternating feed and return strokes to partially eject each successive lowermost newspaper out of the stack, said shuttle including an elongated, raised, support extending in the feeding direction and disposed to press upwardly against each successive lowermost newspaper in the stack in a manner to produce a raised stiffening ridge in the lowermost newspaper and other newspapers of the stack, said ridge having a peak and a pair of generally oppositely inclined side slopes diverging downwardly from the peak, said support having a plurality of spikes disposed to penetrate the lowermost newspaper during each feed stroke of the shuttle in a manner to cause the lowermost newspaper to be driven forwardly with the shuttle during the feed stroke, said spikes being yieldably retractable by engagement with the bottom surface of the lowermost newspaper during the return stroke of the shuttle to keep the spikes from interfering with withdrawal of the lowermost newspaper from the stack after the lowermost newspaper has been partially ejected from the stack by the shuttle;

a pair of downwardly projecting, rigid separating stops at the front of the hopper for blocking newspapers above the lowermost newspaper in the stack from being fed forwardly with the shuttle during its feed stroke, said stops being laterally spaced apart and disposed on opposite sides of the path of travel of the support to present an open space between the stops and directly above the support, each of said stops being generally L-shaped as viewed in side elevation, presenting a generally upright leg and a generally forwardly projecting leg, said upright leg of each stop including a generally upright blocking surface having a lower termination, said forwardly projecting leg of each stop including a generally downwardly and forwardly inclined, and laterally outwardly angled, deflecting surface extending forwardly from and integrally joined with said termination of the blocking surface, said forwardly projecting leg of each stop having a free distal tip, said stops being adjustable relative to the support into such positions that the height of the open space substantially exceeds the thickness of the lowermost newspaper, the terminations of the blocking surfaces are disposed low enough that the surfaces block forward movement of newspapers above the lowermost newspaper without also blocking the lowermost newspaper, and the deflecting surfaces of the stops engage the side slopes of the ridge in the lowermost newspaper as the lowermost newspaper is being driven forwardly by the support; and powered feed rollers in downstream relation to the stops in disposition to receive the leading edge of each successive partially ejected lowermost newspaper and pull the newspaper the rest of the way out of the stack.

35. In a bottom feed newspaper hopper as claimed in claim 34, said stops being integrally connected together above said open space.

36. In a bottom feed newspaper hopper as claimed in claim 35, said legs of the stops being circular in cross-sectional configuration.

37. In a bottom feed newspaper hopper as claimed in claim 35, said stops being constructed from a flat plate.

* * * * *